United States Patent [19]

Drappel et al.

[11] Patent Number: 5,030,535

[45] Date of Patent: Jul. 9, 1991

[54] LIQUID DEVELOPER COMPOSITIONS CONTAINING POLYOLEFIN RESINS

[75] Inventors: Stephan Drappel, Toronto, Canada; Timothy J. Fuller, West Henrietta, N.Y.; Melvin D. Croucher, Oakville, Canada; James D. Mayo, Toronto, Canada; Raymond W. Wong, Mississauga, Canada

[73] Assignee: Xerox Corporation, Stamford, Conn.

[21] Appl. No.: 300,395

[22] Filed: Jan. 23, 1989

[51] Int. Cl.[5] ..... G03G 9/12

[52] U.S. Cl. ..... 430/116; 430/137

[58] Field of Search ..... 430/112, 114, 115, 137, 430/116, 904

[56] References Cited

U.S. PATENT DOCUMENTS 3,977,983 8/1976 Tsuneda .
4,229,513 10/1980 Merrill et al. ..... 430/115
4,526,852 7/1985 Herrmann et al. ..... 430/115

FOREIGN PATENT DOCUMENTS 1436795 5/1976 United Kingdom .

*Primary Examiner*—John Goodrow
*Attorney, Agent, or Firm*—Judith L. Byorick

[57] ABSTRACT

Disclosed is a liquid developer composition comprising a liquid vehicle, a charge control additive, and toner particles containing pigment particles and a resin selected from the group consisting of polyolefins, halogenated polyolefins, and mixtures thereof. Preferred resins include poly-α-olefins and chlorinated polypropylenes. The resin is soluble in the liquid vehicle at elevated temperatures and insoluble in the liquid vehicle at ambient temperatures. Also disclosed is a liquid developer composition comprising a liquid vehicle, pigment particles, a charge control additive, and a resin selected from the group consisting of polyolefins, halogenated polyolefins, and mixtures thereof, wherein the resin is soluble in the liquid vehicle at elevated temperatures and insoluble in the liquid vehicle at ambient temperatures, and wherein the liquid developer is prepared by dissolving the resin in the liquid vehicle at temperatures of from about 80° C. to about 120° C., subsequently adding the pigment particles to the resulting solution, attriting the resulting mixture for from about 20 minutes to about 75 minutes, cooling the mixture to ambient temperature over a period of from about 1 hour to about 3 hours with continuous mixing, and subsequently adding to the mixture the charge control additive.

42 Claims, No Drawings

LIQUID DEVELOPER COMPOSITIONS CONTAINING POLYOLEFIN RESINS

BACKGROUND OF THE INVENTION

The present invention is directed to liquid developer compositions primarily suitable for electrophotographic imaging processes. More specifically, the present invention is directed to liquid developer compositions comprising a liquid vehicle, a pigment, and a resin selected from the group consisting of polyolefins and halogenated polyolefins. Preferably, the resin is either a poly-α-olefin or a chlorinated polypropylene.

Liquid developer compositions containing polyolefin resins are known. For example, British Patent 1,436,795 discloses a negatively charged liquid developer for electrophotography or electrostatic printing which comprises a highly insulating carrier liquid and toner particles dispersed therein. Toner particles may comprise a pigment and a binder resin, which resin may comprise polyvinyl chloride, polyvinylidene chloride, vinyl chloride-vinylidene chloride copolymer, chlorinated polypropylene, vinyl chloride-vinyl acetate copolymer, vinyl chloride-vinyl acetate maleic anhydride copolymer, and others. The developer also contains as a negative charge director a copolymer of specified alkene monomers, one of which possesses from about 8 to about 22 carbon atoms. According to the teachings of this patent, the copolymer contains specific functional groups to control the negative charge on the toner particles, provide dispersibility of the particles, and provide fixability of the toner to paper. The toner composition is prepared by first preparing the charge control additive copolymer, followed by mixing the pigment, the resin, and the carrier liquid and dispersing the mixture for two hours in a sand mill, followed by addition of the copolymer to the mixture to form a liquid developer. In addition, U.S. Pat. No. 3,977,983 discloses a similar negatively charged electrophotographic liquid developer wherein the negative charge control agent is a copolymer wherein the amino group thereof is converted into a quaternary ammonium salt or a quaternary ammonium hydroxide. This copolymer is composed of specified alkene monomers which may include long chain alkenes. The toner particles of the developer may also comprise a binder such as chlorinated polyethylene.

Further, U.S. Pat. No. 4,229,513 discloses a negatively charged liquid electrophotographic developer comprising an electrically insulating carrier liquid such as a paraffinic hydrocarbon fraction having stably dispersed therein a halogenated polymer, such as chlorinated polyethylene, halogenated polypropylene, and others, and having dissolved therein a copolymer of a quaternary ammonium salt monomer and a solubilizing monomer, and a copolymer of a polar monomer and a solubilizing monomer. According to the teachings of this patent, the polymeric quaternary salt and the halogenated polymer act in conjunction to confer negative charge and dispersibility on the toner particles. The liquid developers are prepared by first preparing a toner concentrate, which concentrate is prepared by mixing together the stabilizer polymer, a solvent such as a light aromatic hydrocarbon liquid, and pigments, and ball-milling the mixture for several days. The other components are then added and mixed to obtain the concentrate. Alternatively, a viscous solution of the polymers may be placed on chilled compounding rolls and blended with pigments and other additives. The toner concentrate is then dispersed in an electrically insulating carrier liquid to form the liquid developer.

U.S. Pat. Nos. 3,652,269 and 3,738,833 are of collateral interest, showing the use of a chlorinated polyethylene as a binder resin for a photoreceptor.

U.S. Pat. No. 4,880,720, the disclosure of which is totally incorporated herein by reference, discloses an electrophotographic liquid developer composition comprising a liquid vehicle, first toner particles charged to one polarity and comprising a resin and a first pigment, second toner particles charged to a polarity opposite to that of the first toner particles and comprising a resin and a second pigment of a different color from the first pigment, and a charge director. The toner resin particles may include, among other resins, chlorinated olefins such as chlorinated polypropylene, and poly-α-olefins such as polyoctadecene and polyhexadecene.

Dry electrophotographic developers containing semicrystalline polyolefin resins are disclosed in U.S. Pat. No. 4,952,477 and U.S. Pat. No. 4,990,424, the disclosures of each of which are totally incorporated herein by reference. U.S. Pat. No. 4,952,477 discloses a toner comprising resin particles selected from the group consisting of a semicrystalline polyolefin and copolymers thereof with a melting point of from about 50° C. to about 100° C., and pigment particles. U.S. Pat. No. 4,990,424 discloses a toner composition which comprises a blend of resin particles containing styrene polymers or polyesters and components selected from the group consisting of a semicrystalline polyolefin and copolymers thereof with a melting point of from about 50° C. to about 100° C., and pigment particles. The disclosed toner compositions exhibit lower fusing temperatures and lower fusing energies than many commercially available toners.

Although the known developers are suitable for their intended purposes, a need continues to exist for liquid developers with reduced fusing energies. In addition, there is a need for liquid developers with excellent transfer efficiencies. Further, there is a need for liquid developers containing high concentrations of colored particles. Additionally, a need exists for liquid developers wherein the colored particles have a high pigment to resin ratio. A need also continues to exist for liquid developers that enable the formation of high quality images. Moreover, there is a need for liquid developers that can be prepared rapidly in, for example, about 2 to about 3 hours.

SUMMARY OF THE INVENTION

It is an object of the present invention to provide liquid developers with reduced fusing energies.

It is another object of the present invention to provide liquid developers with excellent transfer efficiencies.

It is yet another object of the present invention to provide liquid developers containing high concentrations of colored particles.

It is still another object of the present invention to provide liquid developers wherein the colored particles have a high pigment to resin ratio.

Another object of the present invention is to provide liquid developers that enable the formation of high quality images.

Yet another object of the present invention is to provide liquid developers that can be prepared rapidly in, for example, from about 2 to about 3 hours.

These and other objects of the present invention are achieved by providing a liquid developer composition comprising a liquid vehicle, a charge control additive, and toner particles containing pigment particles and a resin selected from the group consisting of polyolefins, halogenated polyolefins, and mixtures thereof, said resin being soluble in said liquid vehicle at elevated temperatures and insoluble in said liquid vehicle at ambient temperatures. One embodiment of the present invention is directed to a liquid developer comprising a liquid vehicle, pigment particles, a charge control additive, and a resin selected from the group consisting of polyolefins, halogenated polyolefins, and mixtures thereof, said resin being soluble in said liquid vehicle at elevated temperatures of, for example, from about 75° C. to about 125° C. and insoluble in said liquid vehicle at temperatures of, for example, from about 10° C. to about 65° C. Another embodiment of the present invention is directed to a liquid developer consisting essentially of a liquid vehicle, pigment particles, a charge control additive, and a resin selected from the group consisting of polyolefins, halogenated polyolefins, and mixtures thereof, said resin being soluble in said liquid vehicle at elevated temperatures and insoluble in said liquid vehicle at ambient temperatures, wherein said liquid developer is prepared by dissolving the resin in the liquid vehicle at temperatures of from about 80° C. to about 120° C., subsequently adding the pigment particles to the resulting solution, attriting the resulting mixture for from about 20 minutes to about 75 minutes, cooling the mixture to ambient temperature over a period of from about 1 hour to about 3 hours with continuous mixing, and subsequently adding to the mixture the charge control additive.

Liquid developer compositions of the present invention contain a liquid vehicle that functions as a low conductivity neutral vehicle in which the other components of the developer are uniformly dispersed. The conductivity of the vehicle preferably is less than about $10^{-9}$ (ohm-cm)$^{-1}$ to avoid discharge of the latent image on the imaging member by the liquid. The liquid vehicle is also preferably of a low viscosity, such as less than about 3 centipoise, so that the particles in the developer can undergo rapid electrophoresis in the presence of an electric field to develop the latent image on the imaging member.

Materials suitable for the liquid vehicle include high purity aliphatic hydrocarbons with, for example, from 1 to about 25 carbon atoms and preferably with a viscosity of less than 3 centipoise, such as Norpar ®12, Norpar ®13, and Norpar ®15, available from Exxon Corporation, isoparaffinic hydrocarbons such as Isopar ®G, H, K, L, and M, available from Exxon Corporation, Amsco ® 460 Sovent, Amsco ® OMS, available from American Mineral Spirits Company, Soltrol ®, available from Phillips Petroleum Company, Pagasol ®, available from Mobil Oil Corporation, Shellsol ®, available from Shell Oil Company, and the like. Particularly preferred liquid vehicles are Isopar ®G, Isopar ®H, and Isopar ®L. Generally, the liquid vehicle is present in a large amount in the developer composition, and constitutes that percentage by weight of the developer not accounted for by the other components. The liquid vehicle is usually present in an amount of from about 90 to about 99.4 percent by weight, although the amount may vary and be outside of the provided range provided that the objectives of the present invention are achieved.

Examples of suitable pigment materials for the liquid developers of the present invention include carbon blacks, such as Raven ® 5750 and Raven ® 3500, available from Columbian Chemicals Company, Mogul L, available from Cabot Corporation, Regal 330 ® carbon black, available from Cabot Corporation, and Vulcan XC-72R, available from Cabot Corporation. Colored pigments are also suitable, such as Sudan Blue OS, available from BASF, Hostaperm Pink E, available from American Hoechst Corporation, Novaperm Yellow FGL, available from American Hoechst Corporation, Permanent Yellow FGL, available from American Hoechst Corporation, PV Fast Blue, available from American Hoechst Corporation, Heloigen Blue, available from BASF, Fanal Pink D4830, available from BASF, Lithol Rubine DCC-2734, available from Dominion Color Company, Toner 8200, available from Paul Uhlich & Company, and the like. Generally, any pigment material is suitable provided that it consists of small particles and that it combines effectively with the polymeric resin material. Generally, the pigment is present in the toner particles in an amount of from about 10 to about 50 percent by weight of the particles, and preferably from about 15 to about 45 percent by weight of the particles, with the remaining portion of the toner particles comprising the resin.

The resin contained in the liquid developers of the instant invention is selected from the group consisting of polyolefins, halogenated polyolefins, and mixtures thereof. Preferred resins include poly-α-olefins and chlorinated polypropylenes. The resin is soluble in the liquid vehicle at elevated temperatures of from about 75° C. to about 125° C., and is insoluble in the liquid vehicle at ambient temperatures of from about 10° C. to about 65° C. In addition to exhibiting the correct solubility characteristics in the liquid vehicle, the resins selected also possess the thermal and mechanical properties that are necessary to produce discrete polymer composite particles that do not coalesce during the formation of the liquid developer. In general, it is preferred to have a resin with a modulus greater than about $10^6$ N m$^{-2}$ (Newtons per square meter) at ambient temperature. Preferred resins include chlorinated polypropylene, such as CP-343-1, available from Eastman Kodak Company, and the poly-α-olefins polyhexadecene and polyoctadecene. The preferred polyhexadecenes are of the general formula $(C_{16}H_{32})_x$, and the preferred polyoctadecenes are of the general formula $(C_{18}H_{36})_x$, wherein x is a number of from about 250 to about 21,000, the number average molecular weight is from about 17,500 to about 1,500,000 as determined by GPC, and the $M_w/M_n$ dispersibility ratio is from about 2 to about 15. The polyhexadecenes and polyoctadecenes suitable as resins for the liquid developers of the present invention may be prepared by, for example, the methods set forth in U. Giannini, G. Bruckner, E. Pellino, and A. Cassatta, Journal of Polymer Science, Part C (22), pages 157 to 175 (1968), and in K. J. Clark, A. Turner Jones, and D. G. H. Sandiford, Chemistry in Industry, pages 2010 to 2012 (1962), the disclosures of each of these articles being totally incorporated herein by reference. Generally, the resin is present in the toner particles in an amount of from about 50 to about 90 percent by weight of the toner particles, and preferably from about 55 to about 85 percent by weight of the toner particles, with the remaining portion of the toner particles comprising pigment particles.

The solubility of the polymer resin in the liquid vehicle of the developers of the present invention at elevated temperatures enables the incorporation of pigment in an amount of up to 50 percent by weight of the particle. When the pigment is dispersed into a solution of the liquid vehicle and the resin, the soluble polymer is adsorbed onto the surface of the pigment. Upon lowering of the temperature, the polymer phase separates from solution, forming an encapsulated pigment. The encapsulated particles are initially unstable, and aggregate together until they reach a size where no more aggregation occurs and stable particles are formed. During this process, a large proportion of pigment can be incorporated into the resin, in contrast to toners such as those described in British Patent Application 2,169,416, in which pigment particles are incorporated into resins insoluble in vehicles such as Isopar® at elevated temperatures. For toners as illustrated in the '416 application, it is difficult to incorporate mechanically more than about 20 percent by weight of pigment into the resin, because intimate mixing of the pigment and resin is not enabled by melt blending in an attritor. When more than 20 percent by weight of pigment is used, increasing amounts of unattached pigment are found in the developer, which can often have incorrect charging characteristics and can give rise to background deposits.

When conventional liquid developers containing toner particles comprising a pigment and a resin such as Elvax II 5720, available from E. I. Du Pont de Nemours and Company, are prepared with the maximum amount of pigment incorporated into the resin, which is generally about 20 percent by weight of the particles, the particles are often difficult to charge electrostatically to the desired level since the pigment is buried in the resin with little residing on the surface. Consequently, since it is believed that the interaction of the pigment with the charge director is responsible for charging the particles, the charge on the particle is often low, and charge to mass ratios of less than 60 microcoulombs per gram are often obtained. In order to circumvent this difficulty, charge adjuvant technology as described in U.S. Pat. Nos. 4,702,984: 4,702,985 and 4,758,494 may be employed. In the liquid developers of the present invention, however, considerably more pigment, as much as 50 percent by weight, can be incorporated into the resin. Since more pigment resides at the surface of the composite particle, it is possible to impart an adequate charge to the particles without resorting to charge adjuvant technology, but by using a common charge director.

Conventional liquid developers containing toner particles comprising a pigment and a resin such as Elvax II 5720, available from E. I. Du Pont de Nemours and Company, exhibit relatively high fusing temperatures of from about 100° C. to about 130° C. and correspondingly high fusing energies. These temperatures and energies are approximately equivalent to the temperature and energy often required to fix images developed with dry toners. While not being limited to any particular theory, it is believed that liquid developers containing toner particles comprising a pigment and a resin such as Elvax II 5720 exhibit these fusing temperatures and fusing energies because some of the liquid vehicle becomes entrapped in the toner particles, and that fusing energy in addition to that needed to fix the toner particles to the paper is required to drive the liquid vehicle entrapped in the toner particles into the environment. Accordingly, liquid developers containing toner particles in which a lesser amount of the liquid vehicle becomes entrapped exhibit lower fusing temperatures and lower fusing energies. Liquid developers of the present invention exhibit fusing temperatures of from about 70° C. to about 100° C., and consequently require less energy to fix the images to a substrate.

The toner particles in the developer of the present invention generally have an average particle diameter of from about 0.5 to about 2.5 microns, and preferably from about 0.8 to about 1.8 microns, as determined by a Horiba CAPA-500 centrifugal particle size analyzer, available from Horiba Instruments, Inc., Irvine, Calif., which determines average volume particle diameter. The toner particles generally are present in the liquid developer in amounts of from about 0.5 to about 10 percent by weight of the developer, and preferably from about 0.7 to about 4.0 percent by weight of the developer.

The liquid developer compositions also contain a charge control additive for the purpose of imparting a positive or negative charge to the toner particles. Charge control additives suitable for the present invention include iron naphthenate and zirconium octoate, which are available from Nuodex, lecithin, which is available from Fisher Scientific, basic barium petronate, available from Witco Chemical Company, OLOA 1200, available from Chevron Chemical Company, and the like. Other charge control agents may be employed provided that the objectives of the present invention are achieved. The charge director may be present in an amount of from about 0.01 to about 2.0 percent by weight of the developer, and preferably from about 0.02 to about 0.05 percent by weight of the developer. In general, iron naphthenate and zirconium octoate impart a positive charge to the particles, while basic barium petronate, lecithin, and OLOA 1200 impart a negative charge to the particles. It should be recognized, however, that exceptions to this general rule exist. The charge to mass ratio for the particles is generally from about 50 to about 200 microcoulombs per gram, and preferably from about 80 to about 130 microcoulombs per gram.

Liquid developers of the instant invention generally are prepared by first dissolving the resin in the liquid vehicle by heating at temperatures of, for example, from about 80° C. to about 120° C., and preferably about 105° C. The pigment is then added to the hot polymer solution in an attritor such as a Union Process 01 Attritor, available from Union Process Inc., Akron, Ohio, and the resulting mixture is attrited for from about 20 minutes to about 75 minutes, preferably for about 1 hour. At the end of that period of time, the polymer in solution has adsorbed on the pigment surface to yield a well dispersed pigment. Thereafter, the temperature is lowered to ambient temperature, generally from about 20° to about 25° C., although not limited to this temperature range, over a period of from about 1 hour to about 3 hours, and preferably about 2 hours. During the cooling period the polymer becomes insoluble in the liquid vehicle, thus forming an insoluble resin layer around the pigment particles. The toner particles thus formed generally have an average particle diameter of about 1 micron, as determined by electron microscopy, with particles as small as 0.5 micron and as large as about 2.0 microns also being formed during the preparation of the developer. Another advantage of using resins soluble in the liquid vehicle instead of insoluble resins is that developer concentrates containing up to 40 percent by weight of particles can be prepared by the attrition process. When insoluble resins are employed, it is generally difficult or impossible to obtain developer concentrates with greater than about 20 percent by weight of the particles, since the viscosity of the molten polymer increases the viscosity in the attritor to a level where efficient grinding to form particles cannot be carried out. The economic benefits that accrue to the use of soluble resins is significant in the manufacturing process.

Subsequent addition of the charge director to the dispersion of toner particles in the liquid vehicle results in the liquid developer of the present invention. The resulting developer contains particles which are slightly colloidally unstable. However, even though the particles are unstable on standing in that they flocculate, they are readily dispersed when agitated. Consequently, the developers exhibit long term shelf stability. In addition, it is believed that the slight attraction of the particles for one another results in increased cohesiveness of the image developed with the developer to the photoreceptor, and thus enables transfer efficiencies of from about 95 percent to about 99.9 percent. These transfer efficiencies indicate that from about 95 percent to about 99.9 percent of the toner particles on the photoreceptor are transferred to the substrate on which the image is to be formed, such as paper or transparency material.

Liquid developers of the present invention may be employed in imaging methods wherein an electrostatic latent image is developed with a liquid developer. Generally, the process entails forming an electrostatic latent image on an imaging member, developing the latent image with a developer composition of the present invention, transferring the developed image to a suitable substrate, and permanently affixing the transferred image to the substrate.

Specific embodiments of the invention will now be described in detail. These examples are intended to be illustrative, and the invention is not limited to the materials, conditions, or process parameters set forth in these embodiments. All parts and percentages are by weight unless otherwise indicated.

EXAMPLE I

To 1,750 grams of ¼ inch stainless steel balls in a Union Process 01 attritor was added 96 grams of Isopar ®L, available from Exxon, and 25 grams of CP343-1 resin, a chlorinated polypropylene available from Eastman Kodak Company. The attritor was heated to 90° C. under constant stirring until a homogeneous solution was obtained. Subsequently, 16 grams of Mogul L carbon black, available from Cabot Corporation, was added to the mixture and attrition continued for 1 hour. The attritor was then cooled to 25° C. over a period of two hours under constant stirring, resulting in a dispersion with a solids content of 30 percent by weight, with the average particle diameter being 1.5 microns as measured using a Horiba Centrifugal Analyser. The particles contained 39 percent by weight pigment, as measured using thermogravimetric analysis, and 61 percent by weight resin.

This concentrated dispersion was diluted to a particle concentration of 1.5 percent by weight by the addition of Isopar ®G, available from Exxon, and electrostatically charged by the addition of lecithin obtained from Fisher, Inc. to the dispersion. It was found that 30 milligrams of lecithin per gram of particulate material was necessary to give the particles a negative charge with a charge to mass ratio of 120 microcoulombs per gram. The aforementioned charge measurements were carried out after the ink had been allowed to equilibrate for 24 hours. Subsequently the ink was placed in a commercially available Savin 880 ® copier and used to develop images. Transfer efficiency of the ink to paper was 98 percent as measured gravimetrically. The imaged copy was observed to be dry after exiting from the copier, and the optical density of the solid area of the image was 1.3 as measured with a Macbeth TR927 densitometer with a resolution of 8 line pairs per millimeter. The image was well fixed to the paper, as measured with a Taber Abrader, and exhibited excellent crease resistance, as determined by folding the paper bearing the image and observing no flaking of the image, and excellent smear resistance, as determined by rubbing the image with human fingers.

EXAMPLE II

The procedure described in Example I was repeated using 7 grams of Mogul L carbon black instead of 16 grams, which resulted in a liquid ink with particles containing 22 percent by weight pigment and 78 percent by weight resin. The developer was negatively charged and contained toner particles with a charge to mass ratio of 90 microcoulombs per gram. Subsequently, the ink was incorporated into a Savin 880 ® copier and used to develop images. Transfer efficiency of the ink to paper was 94 percent, and the optical density of the solid area was 1.1. The copy was observed to be dry after exiting from the copier, and the image exhibited excellent fix to the paper, as measured with a Taber Abrader, excellent crease resistance, as determined by folding the paper bearing the image and observing no flaking of the image, and excellent smear resistance, as determined by rubbing the image with human fingers.

EXAMPLE III

The procedure described in Example I was repeated except that Toner 8200, available from Paul Uhlich Company, replaced Mogul L carbon black as the pigment and zirconium octoate, available from Nuodex, replaced lecithin as the charge control agent, resulting in a positively charged liquid developer containing toner particles with a charge to mass ratio of 90 microcoulombs per gram. The ink was placed in a Savin 880 ® copier and used to develop images in a reversal development mode. Transfer efficiency of the ink to paper was 92 percent as measured gravimetrically. The image was observed to be completely dry when exiting from the copier, and the optical density of the solid area was 1.2. Image resolution of the image was 8 line pairs per millimeter, and the prints exhibited excellent crease resistance, as determined by folding the paper bearing the image and observing no flaking of the image, and excellent smear resistance, as determined by rubbing the image with human fingers.

EXAMPLE IV

The procedure described in Example II was repeated except that basic barium petronate, available from Witco Chemical Company, replaced lecithin as the charge control agent, resulting in a negatively charged liquid developer containing toner particles with a charge to mass ratio of 100 microcoulombs per gram. The ink was placed in a Savin 880® copier used to develop images. The copy was observed to be dry after exiting from the machine, and the transfer efficiency of the ink to paper was 97 percent as measured gravimetrically. Solid area density of the image was 1.2, and the resolution obtained was 8 line pairs per millimeter. The image was well fixed to the paper, as measured with a Taber Abrader, and exhibited excellent crease resistance, as determined by folding the paper bearing the image and observing no flaking of the image, and excellent smear resistance, as determined by rubbing the image with human fingers.

EXAMPLE V

The procedure described in Example II was repeated except that polyhexadecene replaced chlorinated polypropylene as the resin, basic barium petronate replaced lecithin as the charge control agent, and the processing was carried out at 110° C. rather than 90° C., resulting in a developer containing toner particles of 1.4 microns in average diameter. When charged with basic barium petronate to a concentration of 20 milligrams of barium petronate per gram of particles, a negatively charged ink containing toner particles with a charge to mass ratio of 110 microcoulombs per gram was obtained. The ink was placed in the developer housing of a Savin 880® copier and used to develop images. Transfer efficiency of the ink to paper was 96 percent as measured gravimetrically, and the optical density of the solid area was 1.2. The copy was observed to be dry upon exiting from the copier. The image was well fixed to the paper, as measured with a Taber Abrader, and exhibited excellent crease resistance, as determined by folding the paper bearing the image and observing no flaking of the image, and excellent smear resistance, as determined by rubbing the image with human fingers.

EXAMPLE VI

The procedure described in Example V was repeated except that polyoctadecene replaced polyhexadecene as the resin and lecithin replaced basic barium petronate as the charge control agent, resulting in a developer containing toner particles of 1.5 microns in average diameter. When electrostatically charged with lecithin to a concentration of 30 milligrams of lecithin per gram of solids in the ink, negatively charged ink containing toner particles with a charge to mass ratio of 120 microcoulombs per gram was obtained. The ink was placed in the developer housing of a Savin 880® copier and used to develop images. Transfer efficiency of the ink to paper was 95 percent as measured gravimetrically, and the optical density of the solid area was 1.2. The copy was observed to be dry upon exiting from the copier. The image was well fixed to the paper, as measured with a Taber Abrader, and exhibited excellent crease resistance, as determined by folding the paper bearing the image and observing no flaking of the image, and excellent smear resistance, as determined by rubbing the image with human fingers.

EXAMPLE VII

The procedure described in Example V was repeated with Toner 8200 replacing Mogul L carbon black as the pigment and zirconium octoate replacing basic barium petronate as the charge control agent, resulting in a developer containing positively charged toner particles with a charge to mass ratio of 100 microcoulombs per gram. The ink was placed in the developer housing of a Savin 880® copier and used to develop images in a reversal development mode. Transfer efficiency of the ink to paper was 95 percent as measured gravimetrically, and the optical density of the solid area was 1.2. The copy was observed to be dry upon exiting from the copier. The image was well fixed to the paper, as measured with a Taber Abrader, and exhibited excellent crease resistance, as determined by folding the paper bearing the image and observing no flaking of the image, and excellent smear resistance, as determined by rubbing the image with human fingers.

EXAMPLE VIII

The procedure described in Example VI was repeated with Toner 8200 replacing Mogul L carbon black as the pigment and zirconium octoate replacing lecithin as the charge control agent, resulting in a positively charged developer containing toner particles with a charge to mass ratio of 110 microcoulombs per gram. The ink was placed in the developer housing of a Savin 880® copier and used to develop images in a reversal development mode. Transfer efficiency of the ink to paper was 95 percent as measured gravimetrically, and the optical density of the solid area was 1.2. The copy was observed to be dry upon exiting from the copier. The image was well fixed to the paper, as measured with a Taber Abrader, and exhibited excellent crease resistance, as determined by folding the paper bearing the image and observing no flaking of the image, and excellent smear resistance, as determined by rubbing the image with human fingers.

EXAMPLE IX

The procedure described in Example I was repeated with OLOA 1200, available from Chevron Chemical Company, replacing lecithin as the charge control agent, resulting in a developer containing negatively charged toner particles with a charge to mass ratio of 120 microcoulombs per gram when 25 mg of OLOA 1200 per gram of solids was added. The ink was placed in the developer housing of a Savin 880® copier and used to develop images. Transfer efficiency of the ink to paper was 95 percent as measured gravimetrically, and the optical density of the solid area was 1.2. The copy was observed to be dry upon exiting from the copier. The image was well fixed to the paper, as measured with a Taber Abrader, and exhibited excellent crease resistance, as determined by folding the paper bearing the image and observing no flaking of the image, and excellent smear resistance, as determined by rubbing the image with human fingers.

EXAMPLE X

The procedure described in Example IX was repeated with 10 grams of Hostaperm Pink E, available from American Hoechst Corporation, replacing Mogul L carbon black as the pigment, resulting in a negatively charged liquid developer containing toner particles with a charge to mass ratio of 100 microcoulombs per gram. The ink was placed in the developer housing of a Savin 880® copier and used to develop images. Transfer efficiency of the ink to paper was 95 percent as measured gravimetrically, and the optical density of the magenta solid area was 1.1. The copy was observed to be dry upon exiting from the copier. The image was well fixed to the paper, as measured with a Taber Abrader, and exhibited excellent crease resistance, as determined by folding the paper bearing the image and observing no flaking of the image, and excellent smear resistance, as determined by rubbing the image with human fingers.

EXAMPLE XI

The procedure described in Example IX was repeated with 10 grams of Sudan Blue OS, available from BASF, replacing Mogul L carbon black as the pigment, resulting in a negatively charged liquid developer containing toner particles with a charge to mass ratio of 100 microcoulombs per gram. The ink was placed in the developer housing of a Savin 880® copier and used to develop images. Transfer efficiency of the ink to paper was 96 percent as measured gravimetrically, and the optical density of the cyan solid area was 1.1. The copy was observed to be dry upon exiting from the copier. The image was well fixed to the paper, as measured with a Taber Abrader, and exhibited excellent crease resistance, as determined by folding the paper bearing the image and observing no flaking of the image, and excellent smear resistance, as determined by rubbing the image with human fingers.

EXAMPLE XII

The procedure described in Example IX was repeated with 10 grams of Permanent Yellow FGL, available from American Hoechst Corporation, replacing Mogul L carbon black as the pigment, resulting in a negatively charged liquid developer containing toner particles with a charge to mass ratio of 100 microcoulombs per gram. The ink was placed in the developer housing of a Savin 880® copier and used to develop images. Transfer efficiency of the ink to paper was 96 percent as measured gravimetrically, and the optical density of the yellow solid area was 1.0. The copy was observed to be dry upon exiting from the copier. The image was well fixed to the paper, as measured with a Taber Abrader, and exhibited excellent crease resistance, as determined by folding the paper bearing the image and observing no flaking of the image, and excellent smear resistance, as determined by rubbing the image with human fingers.

EXAMPLE XIII

The procedure described in Example IX was repeated with 10 grams of Lithol Rubine DCC-2734, available from Dominion Color Company, replacing Mogul L carbon black as the pigment and zirconium octoate replacing OLOA 1200 as the charge detector, resulting in a positively charged liquid developer containing toner particles with a charge to mass ratio of 110 microcoulombs per gram. The ink was placed in the developer housing of a Savin 880® copier and used to develop images in a reverse development mode. Transfer efficiency of the ink to paper was 96 percent as measured gravimetrically, and the optical density of the magenta solid area was 1.1. The copy was observed to be dry upon exiting from the copier. The image was well fixed to the paper, as measured with a Taber Abrader, and exhibited excellent crease resistance, as determined by folding the paper bearing the image and observing no flaking of the image, and excellent smear resistance, as determined by rubbing the image with human fingers.

COMPARATIVE EXAMPLE

To 1,750 grams of ¼ inch stainless steel balls in a Union Process 01 Attritor was added 25 grams of Elvax II 5720 resin, available from E.I. DuPont de Nemours and Company, and 125 grams of Isopar® L, available from Exxon, and the attritor was heated to 115° C. under constant stirring. A colorless fluid was obtained which appeared to indicate that the resin has dissolved in the Isopar, although this was found not to be the case. The resin/Isopar mixture instead formed an isorefractive index dispersion, as was confirmed by passing a Helium-Neon laser beam through the fluid, wherein the laser light was scattered by the fluid, indicating that the resin was not molecularly dispersed in the Isopar (i.e., it was not soluble) but that the components had formed an isorefractive index mixture. To this mixture was added 8 grams of Mogul L carbon black and attrition continued for a further 30 minutes. Subsequently, 150 grams of Isopar® L was added to the mixture and attrition continued for a further 1 hour. The attritor was then cooled to 25° C. over a period of two hours. Attrition was continued for a further three hours at 25° C. for a total processing time of seven hours. The concentration of pigment in the resin was 26 percent as measured by thermogravimetric analysis. When more pigment was added to the molten resin in Isopar®, the percentage of small particles was found to increase, which was believed to be caused by the presence of pigment particles that were unable to be incorporated into the resin. The resulting dispersion had a solids content of 10.7 percent by weight, with the average particle size diameter being 2.7 microns as measured using a Horiba centrifugal analyzer. It was not possible to grind the particles to a smaller particle size by increasing the attrition times using these insoluble resins. After dispersion, the mixture was diluted to a particle concentration of 1.5 percent by weight by the addition of Isopar® G, available from Exxon.

To 70 grams of the above dispersion was then added 0.8 milliliter of a 10 percent solution of lecithin in Isopar® G, and the resulting liquid developer was allowed to equilibrate for 24 hours. Electrical measurements indicated that the charge to mass ratio of the toner particles in the developer was 120 microcoulombs per gram. The developer was then placed in a Savin 880® copier and used to develop images. The solid area of the copy was wet upon exiting from the copier, and the imaged area took from 5 to 10 seconds to dry. Transfer efficiency of the ink to paper was 94 percent as measured gravimetrically, and the optical density of the solid area was 1.3 as measured with a Macbeth TR927 densitometer, with a resolution of 8 line pairs per millimeters.

These examples are illustrative in nature and are not intended to limit the scope of the invention. Other embodiments of the present invention may occur to those skilled in the art, and these are included within the scope of the claims.

What is claimed is:

1. A liquid developer composition consisting essentially of a liquid vehicle, a charge control additive, and toner particles containing pigment particles and a resin selected from the group consisting of polyolefins, halogenated polyolefins, and mixtures thereof, said resin being soluble in said liquid vehicle at elevated temperatures and insoluble in said liquid vehicle at ambient temperatures.

2. A liquid developer composition according to claim 1 wherein the resin is soluble in the liquid vehicle at temperatures of from about 75° C. to about 125° C. and insoluble in said liquid vehicle at temperatures of from about 10° C. to about 65° C.

3. A liquid developer composition according to claim 1 wherein the resin is selected from the group consisting of poly-α-olefins, chlorinated polypropylenes, and mixtures thereof.

4. A liquid developer composition according to claim 1 wherein the liquid vehicle is present in an amount of from about 85 to about 99.5 percent by weight of the developer, the charge control additive is present in an amount of from about 0.01 to about 2.0 percent by weight of the developer, the pigment particles are present in an amount of from about 10 to about 50 percent by weight of the toner particles, and the resin is present in an amount of from about 50 to about 90 percent by weight of the toner particles.

5. A liquid developer composition according to claim 1 wherein the toner particles are present in the liquid developer in an amount of from about 0.5 to about 10 percent by weight.

6. A liquid developer composition according to claim 1 wherein the toner particles comprise from about 10 to about 50 percent by weight of the pigment and from about 50 to about 90 percent by weight of the resin.

7. A liquid developer composition according to claim 1 wherein the liquid vehicle is an isoparaffinic hydrocarbon.

8. A liquid developer composition according to claim 1 wherein the pigment particles are carbon black.

9. A liquid developer composition according to claim 1 wherein the charge control additive is selected from the group consisting of iron naphthenate, zirconium octoate, basic barium petronate, and polyisobutylene succinimide.

10. A liquid developer composition according to claim 1 wherein the resin is selected from the group consisting of chlorinated polypropylene, polyhexadecene, polyoctadecene, and mixtures thereof.

11. A liquid developer composition according to claim 1 wherein the resin is chlorinated polypropylene.

12. A liquid developer composition according to claim 1 wherein the resin is polyhexadecene.

13. A liquid developer composition according to claim 1 wherein the resin is polyoctadecene.

14. A liquid developer composition according to claim 1 wherein the developer exhibits a transfer efficiency of from about 95 percent to about 99.9 percent.

15. A liquid developer composition according to claim 1 wherein images developed with the developer and transferred to a substrate may be fused at temperatures of from about 70° C. to about 100° C.

16. A liquid developer composition consisting essentially of a liquid vehicle, pigment particles, a charge control additive, and a resin selected from the group consisting of polyolefins, halogenated polyolefins, and mixtures thereof, said resin being soluble in said liquid vehicle at elevated temperatures and insoluble in said liquid vehicle at ambient temperatures, wherein said liquid developer is prepared by dissolving the resin in the liquid vehicle at temperatures of from about 80° C. to about 120° C., subsequently adding the pigment particles to the resulting solution, attriting the resulting mixture for from about 20 to about 75 minutes, cooling the mixture to ambient temperature with continuous mixing, and subsequently adding to the solution the charge control additive to form a developer containing toner particles consisting of the resin and the pigment particles.

17. A liquid developer according to claim 16 wherein the mixture is cooled to ambient temperature over a period of from about 1 to about 3 hours.

18. A liquid developer composition according to claim 16 wherein the resin is selected from the group consisting of poly-α-olefins, chlorinated polypropylenes, and mixtures thereof.

19. A liquid developer composition according to claim 16 wherein the liquid vehicle is present in an amount of from about 90 to about 99.4 percent by weight of the developer, the charge control additive is present in an amount of from about 0.01 to about 2.0 percent by weight of the developer, the pigment particles are present in an amount of from about 10 to about 50 percent by weight of the toner particles, and the resin is present in an amount of from about 50 to about 90 percent by weight of the toner particles.

20. A liquid developer composition according to claim 16 wherein the toner particles are present in the liquid developer in an amount of from about 0.5 to about 10 percent by weight of the developer.

21. A liquid developer composition according to claim 16 wherein the toner particles comprise from about 10 to about 50 percent by weight of the pigment and from about 50 to about 90 percent by weight of the resin.

22. A liquid developer composition according to claim 16 wherein the liquid vehicle is an isoparaffinic hydrocarbon.

23. A liquid developer composition according to claim 16 wherein the pigment particles are carbon black.

24. A liquid developer composition according to claim 16 wherein the charge control additive is selected from the group consisting of iron naphthenate, zirconium octoate, basic barium petronate, and polyisobutylene succinimide.

25. A liquid developer composition according to claim 16 wherein the resin is selected from the group consisting of chlorinated polypropylene, polyhexadecene, polyoctadecene, and mixtures thereof.

26. A liquid developer composition according to claim 16 wherein the resin is chlorinated polypropylene.

27. A liquid developer composition according to claim 16 wherein the resin is polyhexadecene.

28. A liquid developer composition according to claim 16 wherein the resin is polyoctadecene.

29. A liquid developer composition according to claim 16 wherein the developer exhibits a transfer efficiency of from about 95 percent to about 99.9 percent.

30. A liquid developer composition according to claim 16 wherein images developed with the developer and transferred to a substrate are capable of being fused at temperatures of from about 70° C. to about 100° C.

31. A method of imaging which comprises forming an electrostatic latent image on an imaging member, developing the latent image by contacting it with the developer composition of claim 1, transferring the developed image to a substrate, and permanently affixing the developed image to the substrate.

32. A method according to claim 31 wherein the developed image is permanently affixed to the substrate at temperatures of from about 70° C. to about 100° C.

33. A method of imaging which comprises forming an electrostatic latent image on an imaging member, developing the latent image by contacting it with the developer composition of claim 16, transferring the developed image to a substrate, and permanently affixing the developed image to the substrate.

34. A method according to claim 33 wherein the developed image is permanently affixed to the substrate at temperatures of from about 70° C. to about 100° C.

35. A liquid developer composition which comprises a liquid vehicle, a charge control additive, and toner particles containing pigment particles and a resin selected from the group consisting of polyolefins, halogenated polyolefins, and mixtures thereof, said resin being soluble in said liquid vehicle at elevated temperatures and insoluble in said liquid vehicle at ambient temperatures.

36. A liquid developer composition according to claim 35 wherein the resin is selected from the group consisting of poly-α-olefins, chlorinated polypropylenes, and mixtures thereof.

37. A liquid developer composition comprising a liquid vehicle, pigment particles, a charge control additive, and a resin selected from the group consisting of polyolefins, halogenated polyolefins, and mixtures thereof, said resin being soluble in said liquid vehicle at elevated temperatures and insoluble in said liquid vehicle at ambient temperatures, wherein said liquid developer is prepared by dissolving the resin in the liquid vehicle at temperatures of from about 80° C. to about 120° C., subsequently adding the pigment particles to the resulting solution, attriting the resulting mixture for from about 20 to about 75 minutes, cooling the mixture to ambient temperature with continuous mixing, and subsequently adding to the solution the charge control additive to form a developer containing toner particles consisting of the resin and the pigment particles.

38. A liquid developer composition according to claim 37 wherein the resin is selected from the group consisting of poly-α-olefins, chlorinated polypropylenes, and mixtures thereof.

39. A process for preparing a liquid developer composition which comprises dissolving in a liquid vehicle at temperatures of from about 80° C. to about 120° C. a resin selected from the group consisting of polyolefins, halogenated polyolefins, and mixtures thereof, said resin being soluble in said liquid vehicle at elevated temperatures and insoluble in said liquid vehicle at ambient temperatures, subsequently adding pigment particles to the resulting solution, attriting the resulting mixture for from about 20 to about 75 minutes, cooling the mixture to ambient temperature with continuous mixing, and subsequently adding to the solution a charge control additive.

40. A process according to claim 39 wherein the mixture is cooled to ambient temperature over a period of from about 1 to about 3 hours.

41. A process according to claim 39 wherein the resin is selected from the group consisting of poly-α-olefins, chlorinated polypropylenes, and mixtures thereof.

42. A liquid developer composition consisting essentially of a liquid vehicle, a charge control additive, and toner particles containing pigment particles and a resin selected from the group consisting of poly-α-olefins, chlorinated polypropylenes, and mixtures thereof, said resin being soluble in said liquid vehicle at temperatures of from about 75° C. to about 125° C. and insoluble in said liquid vehicle at temperatures of from about 10° C. to about 65° C.

* * * * *